United States Patent [19]

Morita et al.

[11] Patent Number: 4,744,346

[45] Date of Patent: May 17, 1988

[54] FUEL CONTROL APPARATUS IN INTERNAL COMBUSTION ENGINE

[75] Inventors: Kiyomi Morita, Katsuta; Junji Miyake, Mito; Keiji Hatanaka, Chigasaki; Kiyotoshi Sakuma, Yokohama, all of Japan

[73] Assignees: Hitachi, Ltd., Tokyo; Nissan Motor Co., Ltd., Yokohama, both of Japan

[21] Appl. No.: 88,417

[22] Filed: Aug. 24, 1987

[30] Foreign Application Priority Data

Sep. 1, 1986 [JP] Japan ..... 61-203714

[51] Int. Cl.[4] ..... F02M 51/00

[52] U.S. Cl. ..... 123/492; 364/431.05

[58] Field of Search ..... 123/492, 489, 493; 364/431.05, 431.07

[56] References Cited

U.S. PATENT DOCUMENTS 4,543,937 10/1985 Amano et al. ..... 123/492
4,548,181 10/1985 Ishikawa et al. ..... 123/492
4,571,683 2/1986 Kobayoshi et al. ..... 364/431.05
4,582,037 4/1986 Otsuka et al. ..... 123/492
4,590,912 5/1986 Atago ..... 123/492
4,626,997 12/1986 Takada et al. ..... 364/431.05
4,628,883 12/1986 Kataoka ..... 123/489
4,630,201 12/1986 Amano et al. ..... 364/431.07

*Primary Examiner*—Raymond A. Nelli
*Attorney, Agent, or Firm*—Antonelli, Terry & Wands

[57] ABSTRACT

Disclosed is a fuel control apparatus in an internal combustion engine. When the running mode the engine is changed into acceleration again from deceleration after acceleration, the fuel becomes too rich if the conventional continuous correcting factor is used. In order to properly reduce the quantity of fuel supply in that case, the number of engine revolutions is counted from a point of initiation of deceleration to a point of initiation of acceleration again to thereby calculate a proper value of the continuous correcting factor corresponding to the count, so that fuel is supplied to the internal combustion engine with a quantity corrected by the thus calculated value of the continuous correcting factor.

7 Claims, 4 Drawing Sheets

FUEL CONTROL APPARATUS IN INTERNAL COMBUSTION ENGINE

BACKGROUND OF THE INVENTION

The present invention relates to a fuel control apparatus in a car internal combustion engine, and particularly relates to a fuel control apparatus which is suitable to obtain an optimum air-fuel ratio (hereinafter simply abbreviated to "A/F") in acceleration again through deceleration after acceleration.

Generally, an air flow rate changes in proportion to the opening of a throttle valve. However, even if the throttle valve is fully closed from a fully opened state, air flow cannot immediately respond to the closure of the throttle valve but responds with a temporal delay.

This is because a suction air path has a length to the throttle valve and an air flow rate sensor is provided upstream the throttle valve. Accordingly, in spite of the fact that the value A/F should be made rich when the throttle valve is moved toward the open side, that is, when the engine is accelerated, the value of A/F can not be made so rich as to sufficiently accelerate the engine even if an optimum fuel supply quantity calculated on the basis of the suction air quantity detected by the air flow rate sensor is injected through a fuel injector. Therefore, the control delay due to determination of the fuel supply quantity by means of the air flow rate sensor has been conventionally corrected by increasing the opening of the throttle valve.

Conventionally, in a system in which acceleration correction is performed by using a throttle sensor as disclosed in Japanese patent unexamined publication No. 58-185949, so-called constant acceleration correction in which a quantity of change per predetermined unit time, that is, a quantity of differentiation, of an output of the throttle sensor is detected, and the fuel supply quantity calculated on the basis of the suction air quantity detected by the air flow rate sensor is multiplied by a certain factor (for example, 1.1) to thereby increase the fuel supply quantity when the change of rate of the output of the throttle sensor exceeds a predetermined value.

Thus, in the conventional acceleration corection, even in the case where after acceleration, deceleration is once performed for a short time and then acceleration is to be made again, the fuel supply is increased by the same quantity as in the first acceleration. However, the whole of the increased fuel injected upstream the throttle valve is not evaporated so as to be sucked into a cylinder, but some of the fuel is liquefied and adheres to the side wall of the carburetor. Accordingly, if the fuel supply is increased by the same quantity as in the first time acceleration when acceleration is to be made again after deceleration is made once after the first time acceleration, the fuel becomes so rich disadvantageously that not only the fuel consumption rate becomes poor but complete combustion cannot be obtained and exhaust gas characteristics becomes poor.

Gasoline atomized in the vicinity of the throttle chamber is used to wet a collector by a quantity of several percent and the remainder quantity of the gasoline is sucked into the engine through an intake manifold.

On the contrary, the adhering gasoline is evaporated by several percent of the whole quantity thereof and sucked into the engine together with the atomized gasoline so as to contribute to the combustion. Accordingly, when the engine is in a steady state, the whole quantity of adhering gasoline is constant and is called an equilibrated adhering quantity (hereinafter simply referred to "MFH"). The MFH is a function of a water temperature and a load (it may be considered as a negative pressure quantity), so that the MFH is large when the engine output is high, while small when the engine output is low. When acceleration is made by increasing the opening of a throttle, gasoline is used for filling the quantity of increase of the MFH even if the gasoline is injected by a quantity corresponding to the suction air quantity, so that the air-fuel mixture actually sucked into the engine becomes lean. To correct this state, the quantity of fuel injection is increased by a little quantity. This acceleration is called "increased-fuel acceleration".

SUMMARY OF THE INVENTION

It is therefore an object of the present invention to solve the problems as described above in the prior art.

It is another object of the present invention to provide a fuel control apparatus in an internal combustion engine which can properly control an air-fuel ratio when the internal combustion engine is accelerated a short time after deceleration.

It is a further object of the present invention to provide a fuel control apparatus in an internal combustion engine in which the rate of increase of fuel supply is lowered when the engine is accelerated again in a predetermined time after deceleration, because when the engine is accelerated again in a predetermined time after deceleration it is not necessary to increase the fuel supply with the rate of increase used in the preceding acceleration because of existence of vapored fuel atached on an inner wall surface of a carburetor at that time.

In order to attain the above objects, according to the present invention, in a fuel control apparatus of an internal combustion engine arranged to increase a quantity of fuel supply uniquely determined on the basis of an engine speed and a quantity of suction air by a predetermined quantity upon detection of acceleration of the internal combustion engine, the number of engine revolutions is calculated upon detection of deceleration, and when acceleration is detected again before the value of integration of the number of engine revolutions reaches a predetermined value, the predetermined quantity of increasing the fuel supply is reduced in accordance with the value of integration of the number of engine revolutions.

BRIEF DESCRIPTION OF THE DRAWINGS

Other objects and advantages of the invention will become apparent during the following discussion of the accompanying drawings, wherein.

DESCRIPTION OF THE PREFERRED EMBODIMENT

Figure 1:
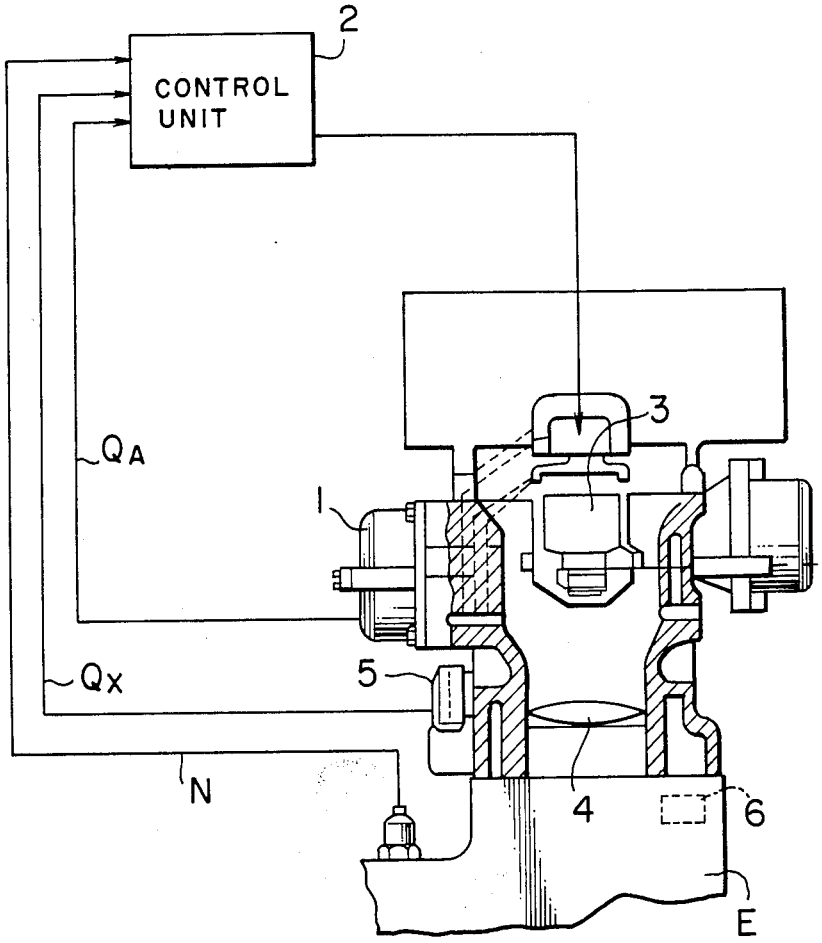
FIG. 1 is a front view showing a schematic arrangement of a fuel control system to which the fuel control apparatus according to the present invention is applied.

Referring to the drawings, an embodiment of the fuel control apparatus according to the present invention will be described hereunder.

FIG. 1 illustrates a carburetor to which the present invention is applied.

In the drawing, air sucked into an engine E is measured by means of an air flow rate sensor 1 and the value measured by the air flow rate sensor 1 is taken into a control unit 2. The control unit 2 counts a pulse generated from a crank angle sensor so as to obtain the number of engine revolutions N, calculates a quantity of fuel supply corresponding to the value of N, and then applies a pulse having a pulse width corresponding to the calculated fuel supply quantity to an injector 3. The injector 3 injects fuel of the quantity corresponding to the pulse width of the pulse applied thereto. The basic pulse width $T_P$ applied to the injector 3 can be expressed by the following equation (1):

$$T_P = k \times Q_A / N \quad (1)$$

where, $Q_A$, N, and k represent the quantity of suction air, the engine revolutional speed, and a constant respectively. The control unit 2 further samples an output of a throttle sensor 5 representing the opening of a throttle valve 4, every $T_1$ m sec (for example, 10 m sec) to thereby detect a change in quantity of the throttle opening in the time of $T_1$ m sec. The control unit 2 regards the running state as acceleration and selects a proper one of values of an acceleration correcting factor $k_D$ set in advance when the following expression is satisfied:

$$\theta_x - \theta_{x-1} > \theta_1$$

where $\theta_x$ and $\theta_{x-1}$ represent the latest value of the throttle opening and the value of throttle opening before $T_1$ m sec, respectively. The value of the acceleration correcting factor $k_P$ is determined on the basis of the engine speed, the throttle opening, and the rate of change of the throttle opening. The value is obtained in advance.

The basis injection pulse width $T_P$ is corrected according to the following equation:

$$T_i = T_P \times (1 + k_D) \times k_{CNT} \quad (2)$$

wherein $T_i$ represents the corrected injection pulse width, and $k_{CNT}$ represents a continuous acceleration correcting factor which will be described later.

Figure 2:
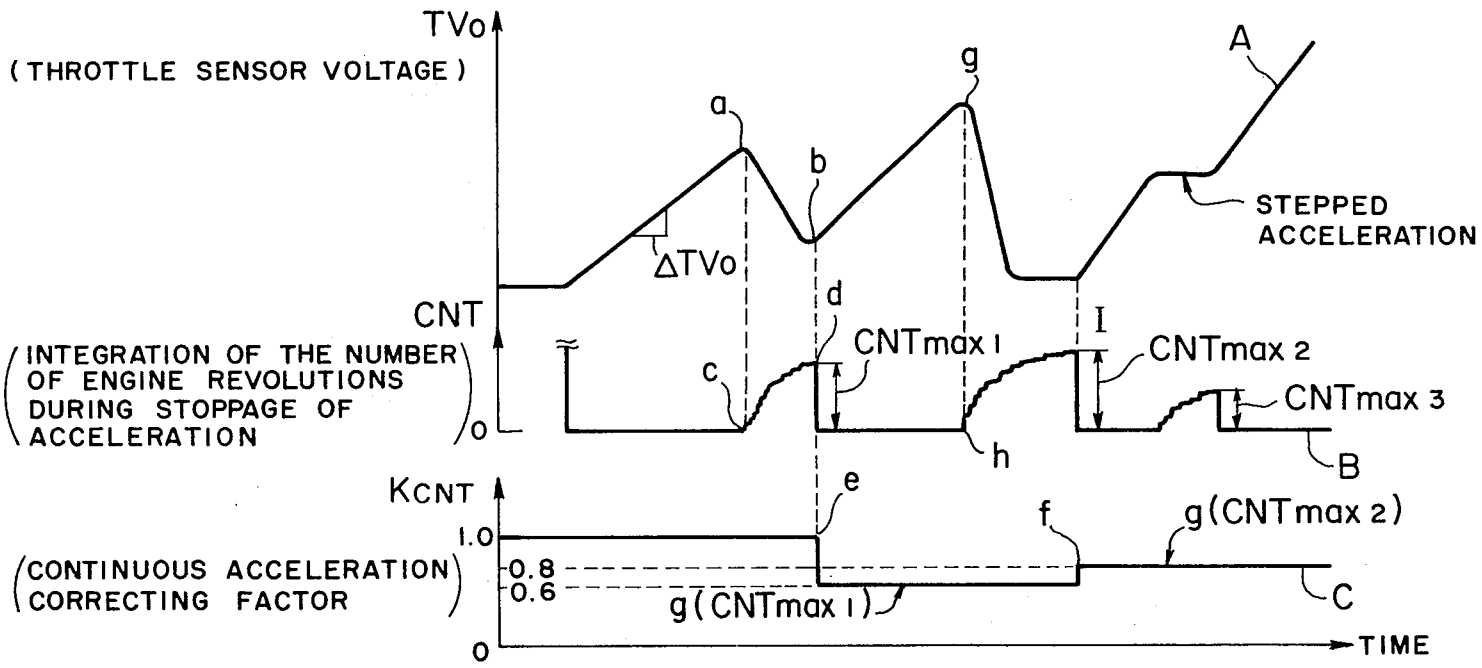
FIG. 2 is an operational waveform diagram for explaining the operation of an embodiment of the fuel control apparatus according to the present invention.
Figure 3:
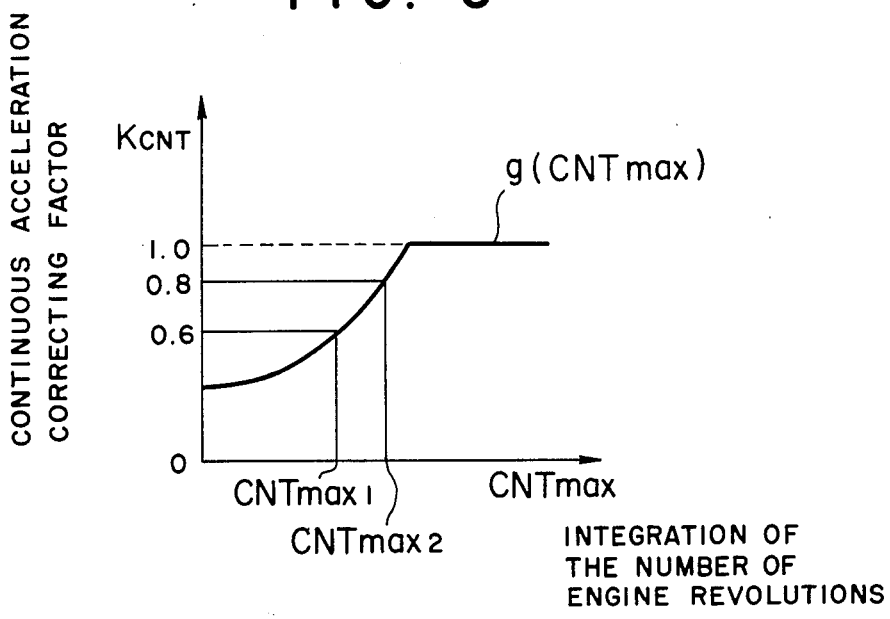
FIG. 3 is a graph showing relation between the continuous acceleration correcting factor and the value of integration of the number of engine revolutions in the embodiment according to the present invention.

FIG. 2 shows a throttle sensor pattern in continuous acceleration. Assume that a throttle sensor voltage has change in accordance with the opening/closing operation of the throttle valve as shown in FIG. 2A. First, when acceleration is detected on the basis of rate of change $TV_o$ of the throttle sensor voltage, the acceleration fuel increase is immediately performed with the continuous acceleration correcting factor $k_{CNT}$ of 1.0. Next, when the running state is changed into deceleration at a point a in FIG. 2, the acceleration correcting factor $k_D$ is made zero, and the integration of the number of crank shaft revolutions represented by B in FIG. 2 is initiated from a point c corresponding to the above-mentioned point a. This integration of the number of crank shaft revolutions is continued to a point d corresponding to a point b of next acceleration. The count or the value of integration at the point d is $CNT_{max\ 1}$. A continuous acceleration correcting factor is determined in accordance with the continuous acceleration correcting characteristics shown in FIG. 3 on the basis of the integrated value of the number of crank shaft revolutions at that time. That is, for example, $g(CNT_{max\ 1})$ which is 0.6 times of the normal value of the continuous acceleration correcting factor $k_{CNT}$ is used as the continuous acceleration correcting factor at that time. Thus, 0.6 which is smaller than 1.0 is given as the value of the acceleration correcting factor in the range from the point b to the point g in the curve A of FIG. 2. If acceleration is performed from the point b, and then deceleration is effected again from the point g, the integration of the number of crank shaft revolutions is initiated again from a point h corresponding to the point g and continued till next acceleration is detected again. A continuous acceleration correcting factor of, for example, 0.8 is determined in accordance with the continuous acceleration correcting characteristics of FIG. 3 on the basis of the integrated value of the number of crank shaft revolutions $CNT_{max\ 2}$ at that time. When the count $CNT_{max\ 2}$ exceeds a predetermined value (for example, 50), the continuous acceleration correcting factor is never corrected.

Figure 4:
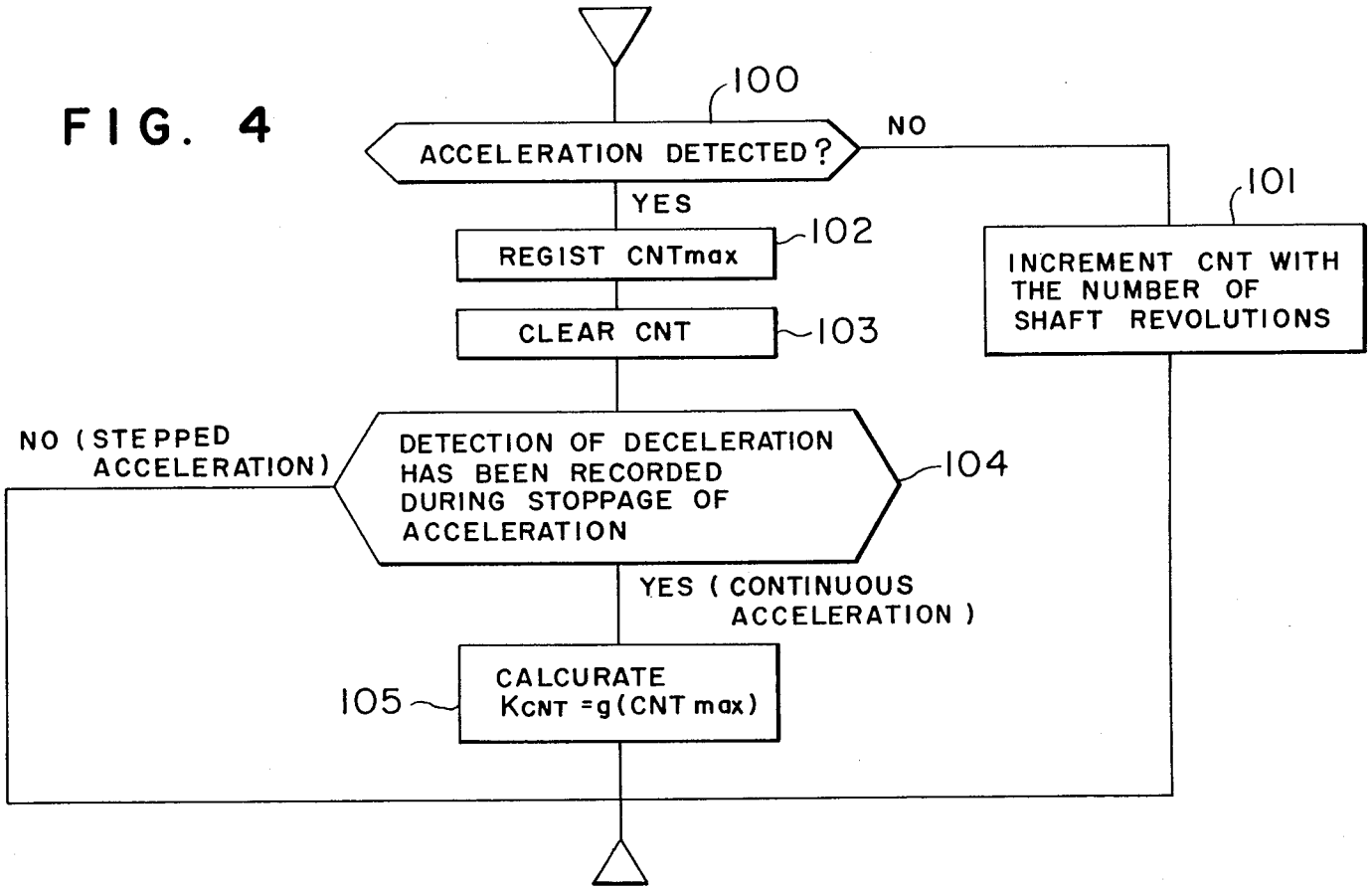
FIG. 4 is a flow-chart for obtaining the continuous acceleration correcting factor.

FIG. 4 is a flowchart for calculating the continuous acceleration correcting factor $k_{CNT}$.

In the drawing, a judgement is made as to whether acceleration is detected or not in a step 100. When acceleration is not detected, the count of a counter CNT is incremented by the number of crank shaft revolutions so that the number of crank shaft revolutions is integrated in a step 101. When acceleration is detected in the step 100, on the contrary, the maximum value of the counter CNT is registered in a step 102, and the counter CNT is cleared in a step 103. Next, a judgement is made in a step 104 as to whether detection of deceleration has been recorded or not in the period of stopping accelerating. If there is no record, the flow is ended. If the judgement proves that there is a record of detection of deceleration in the period of stopping acceleration, that is, if the judgement proves that there is the second-time acceleration stating from the point b or a point I, in the step 104, a continuous acceleration correcting factor $g(CNT_{max})$ is calculated by reducing the continuous acceleration correcting factor $k_{CNT}$ corresponding to the count of the counter CNT and puts the calculated value out.

The value of the continuous acceleration correcting factor $k_{CNT}$ can be obtained by reading of a table. That is, various values of $k_{CNT}$ corresponding to various representative points of $CNT_{max}$ are stored in advance, so that a proper value of $k_{CNT}$ corresponding to the value of $k_{CNT}$ can be read out of the stored values. A proper value of $k_{CNT}$ corresponding to an intermediate value between adjacent two stored values of $CNT_{max}$ can be obtained by interporation calculation.

Figure 5:
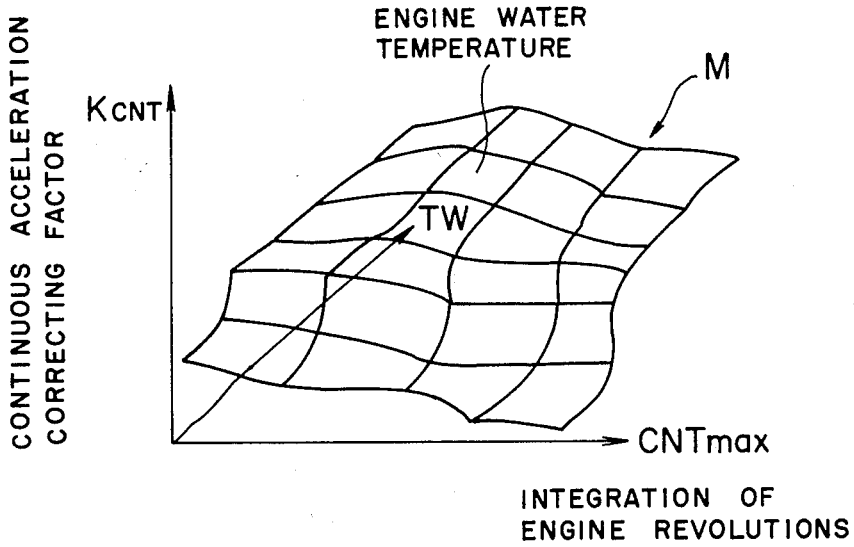
FIG. 5 is a perspective view showing a map for obtaining the continuous acceleration correcting factor.

A map M can be used instead of the table. That is, since the above-mentioned equilibrated adhering quantity (MFH) is a function of an engine water temperature TW, a map can be made as shown in FIG. 5, by preparing a plurality of tables of the relation of $CNT_{max}$ to $k_{CNT}$ for various values of the water temperature.

Although a sensor for detecting a throttle opening is used as means for detecting a running state in acceleration in the embodiment described above, the air flow rate sensor 1 (FIG. 1) or a pressure sensor 6 (FIG. 1) may be used in place of the throttle opening detecting sensor.

As described above, according to the present invention, air fuel ratio can be made optimum in the running state of acceleration again in a short time after deceleration.

We claim:

1. A fuel control apparatus in an internal combustion engine arranged to increase a quantity of fuel supply uniquely determined on the basis of an engine speed and a quantity of suction air by a predetermined quantity upon detection of acceleration of said internal combustion engine; said apparatus comprising:

a detection means for detecting acceleration and deceleration of said internal combustion engine;

an engine speed operation means for calculating the number of engine revolutions, said engine speed operation means being arranged to perform the calculation from a point in time when acceleration is detected by said detection means to a point in time when deceleration is detected by said detection means;

a calculation means for calculating a continuous acceleration correcting factor representing a quantity to be subtracted from said predetermined quantity in accordance with the value of integration of the number of engine revolutions calculated by said engine speed operation means; and a fuel supply means for supplying fuel to said internal combustion engine in accordance with an output of said calculation means.

2. A fuel control apparatus in an internal combustion engine according to claim 1, in which said detecting means includes a throttle sensor for detecting the opening of a throttle valve.

3. A fuel control apparatus in an internal combustion engine according to claim 1, in which said detection means includes an air flow rate sensor for detecting an air flow rate.

4. A fuel control apparatus in an internal combustion engine according to claim 1, in which said detection means includes a pressure sensor for detecting a pressure in a combustion chamber.

5. A fuel control apparatus in an internal combustion engine according to claim 1, in which said calculating means is arranged to perform the calculation by using a table of said continuous acceleration correcting factor which is represented as a function of said value of integration of the number of engine revolutions.

6. A fuel control apparatus in an internal combustion engine according to claim 1, in which said calculation means is arranged to perform the calculation by using a map formed of a plurality of tables of said continuous acceleration correcting factor represented as a function of said value of integration of the number of engine revolutions for various values of an engine water temperature.

7. A fuel control apparatus in an internal combustion engine arranged to increase a quantity of fuel supply uniquely determined on the basis of an engine speed and a quantity of suction air by a predetermined quantity upon detection of acceleration of said internal combustion engine; said apparatus comprising:

a throttle sensor for detecting acceleration and deceleration of said internal combustion engine;

a counter means for counting the number of engine revolutions, said counter means being arranged to perform the counting from a point in time when acceleration is detected by said throttle sensor to a point in time when deceleration is detected by said throttle sensor;

a calculation means for calculating a continuous acceleration correcting factor representing a quantity to be subtracted from said predetermined quantity in accordance with the value of integration of the number of engine revolutions calculated by said counter means; and a fuel supply means including a control unit and an injector for supplying fuel to said internal combustion engine in accordance with an output of said calculation means.

* * * * *